United States Patent [19]

Gaffney et al.

[11] Patent Number: 4,823,409

[45] Date of Patent: Apr. 25, 1989

[54] SHEET FLOW SPOUT

[75] Inventors: Thomas E. Gaffney, Sheboygan, Wis.; Patrick S. Wahlen, West Lafayette, Ind.

[73] Assignee: Kohler Co., Kohler, Wis.

[21] Appl. No.: 2,842

[22] Filed: Jan. 13, 1987

[51] Int. Cl.[4] ..... E03C 1/04

[52] U.S. Cl. ..... 4/192; 239/523; 239/590; 023/255

[58] Field of Search ..... 4/191, 192, 619; D23/255–257; 137/801; 239/523, 590, 390

[56] References Cited

U.S. PATENT DOCUMENTS

| | | | |
|---|---|---|---|
| D. 217,966 | 7/1970 | Korol . | |
| D. 268,949 | 5/1983 | Delepine . | |
| 695,967 | 3/1902 | Thurman | 239/590 |
| 968,252 | 8/1910 | Moore | 239/590 X |
| 975,482 | 11/1910 | Tucker | 239/390 X |
| 1,290,736 | 1/1919 | Greenberg . | |
| 1,383,886 | 7/1921 | Webb, Sr. . | |
| 1,406,030 | 2/1922 | Kelly . | |
| 1,417,583 | 5/1922 | Stratton . | |
| 1,426,046 | 8/1922 | Cohen | 4/191 |
| 2,775,485 | 12/1956 | Miller | 239/523 X |
| 3,081,041 | 3/1963 | Showalter | 239/523 X |
| 3,144,211 | 8/1964 | Goldman | 239/523 X |
| 3,312,402 | 4/1967 | Lyon | 239/590 X |
| 3,365,137 | 1/1968 | Corsette | 239/523 X |
| 4,334,328 | 6/1982 | Delepine . | |
| 4,513,458 | 4/1985 | Delepine . | |

FOREIGN PATENT DOCUMENTS

| | | | |
|---|---|---|---|
| 58607 | 5/1968 | Belgium . | |
| 130098 | 1/1985 | European Pat. Off. . | |
| 2855010 | 6/1980 | Fed. Rep. of Germany | 4/191 |
| 2333578 | 7/1977 | France . | |
| 2350144 | 12/1977 | France . | |
| WO8502132 | 5/1985 | PCT Int'l Appl. . | |
| 161778 | 7/1933 | Switzerland . | |

OTHER PUBLICATIONS

Brochure of Grohe, "Flood Spray Shower Heads", Undated, Admitted Prior Art.

Brochure of Hans Grohe, dated 1980. Water Rainbow Fill Spout Installation Instructions, date 1984. April, 1986 Jacuzzi ad entitled "Vectra", admitted prior art. Drawings and Specification of U.S. Patent Application Ser. No. 3,005, Brochure illustrating Model 7662,7612BR, and 7612PB spouts, undated, admitted prior art.

*Primary Examiner*—Charles E. Phillips

*Attorney, Agent, or Firm*—Quarles & Brady

[57] ABSTRACT

A spout for providing a flow of water in the form of a sheet is disclosed. Water from a supply pipe is diverted orthogonally in two directions as it enters a reservoir inside the spout. Water pooled in the reservoir spills over a weir to form a sheet-shaped flow stream as it flows down the weir. The weir has a raised center section which helps define a flow chamber to promote and develop a stream which maintains a sheet shape even relatively great distances from the spout.

4 Claims, 4 Drawing Sheets

FIG. 1
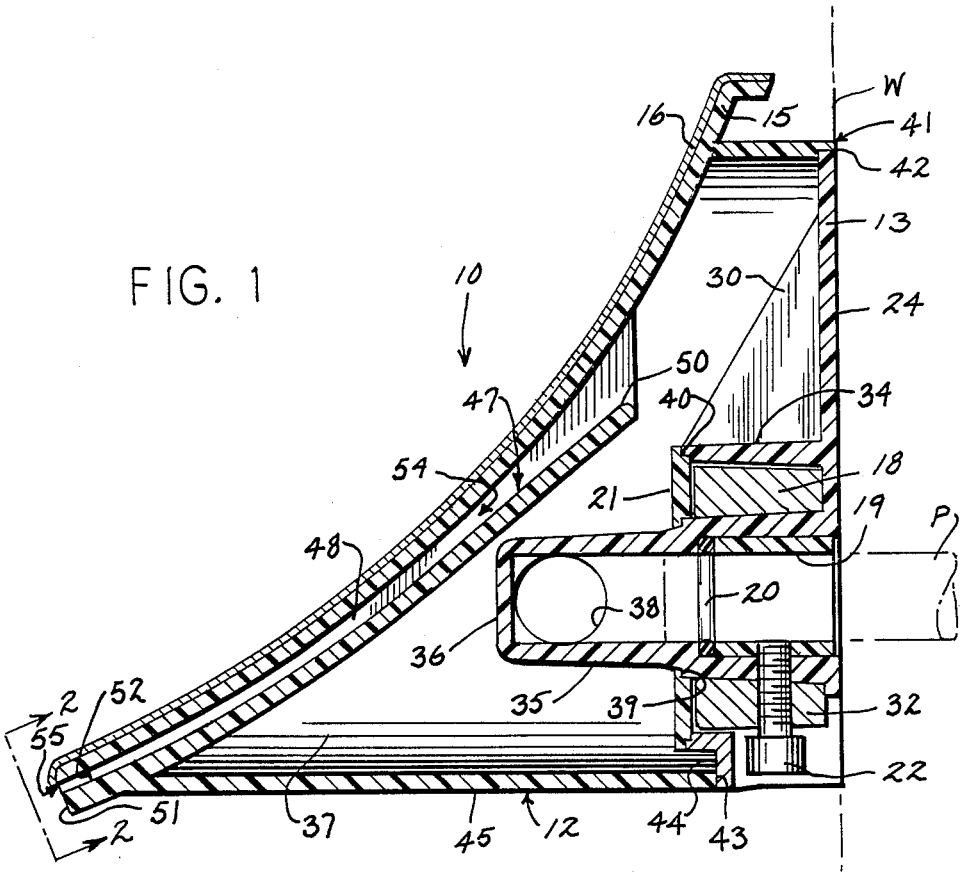
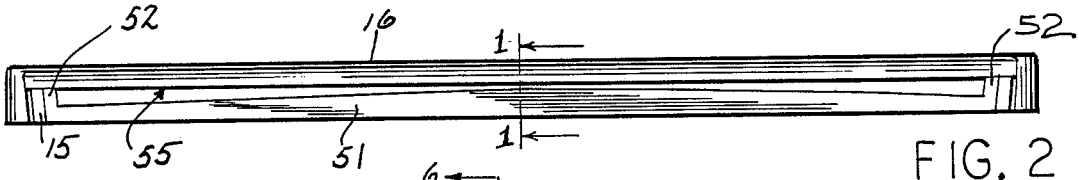
FIG. 2
FIG. 3
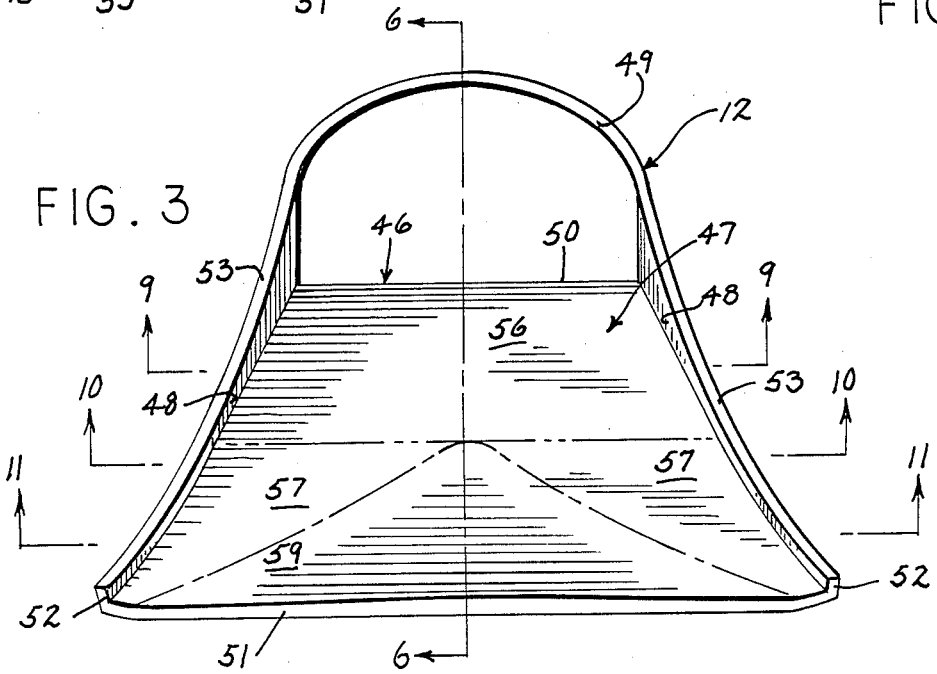

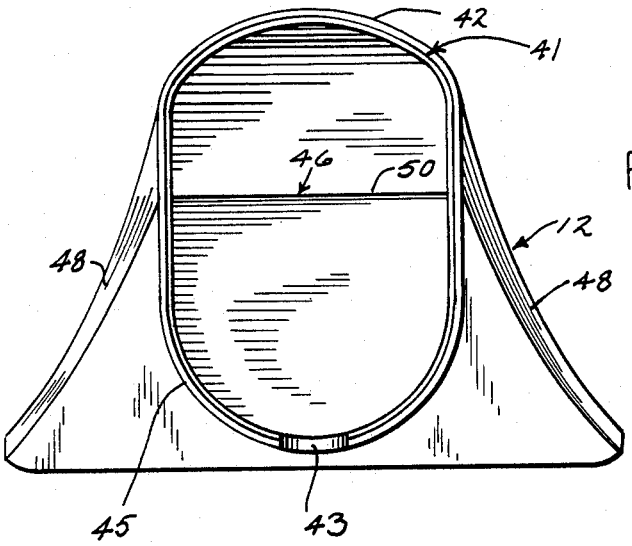
FIG. 4
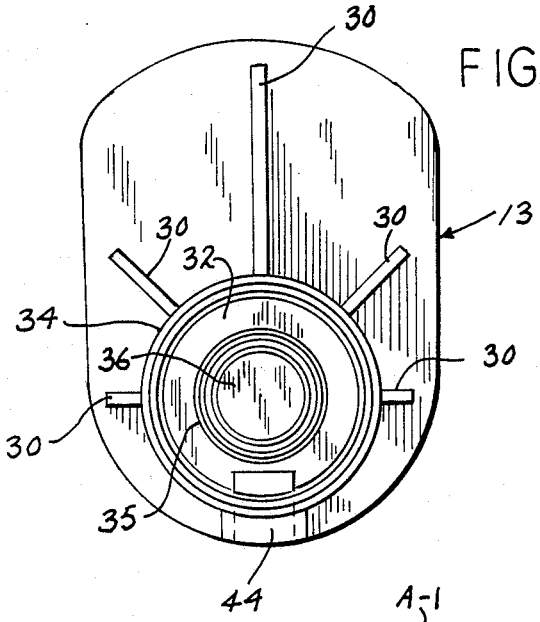
FIG. 5
FIG. 6
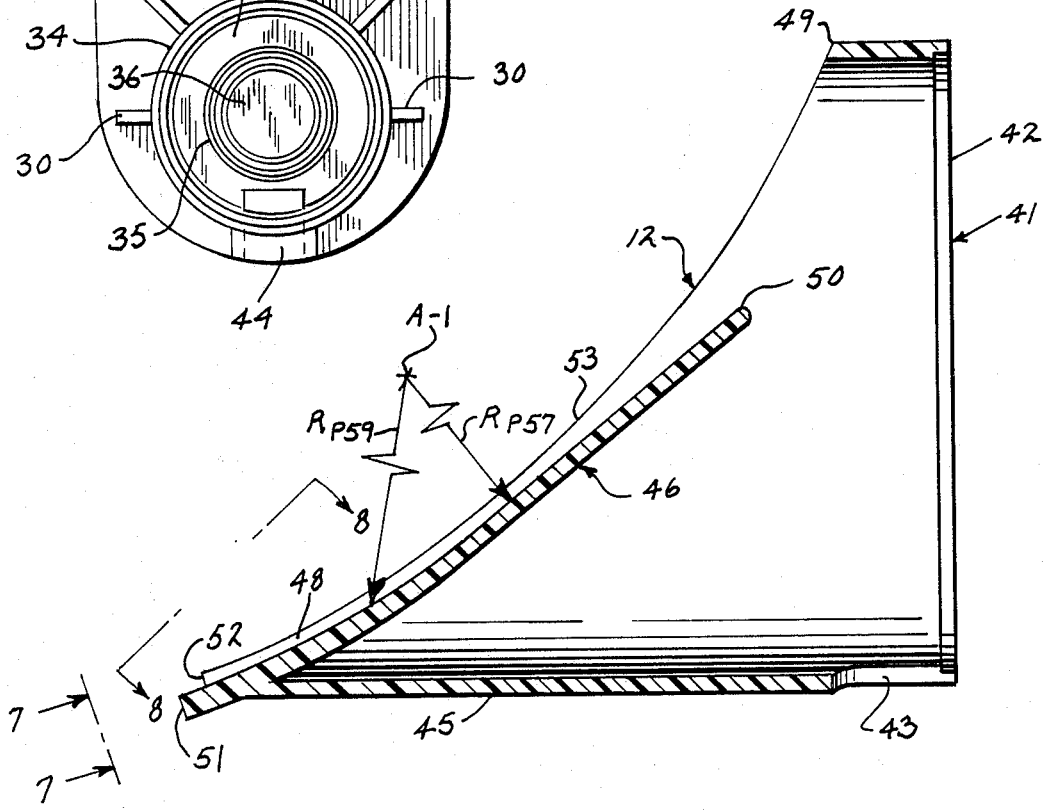

SHEET FLOW SPOUT

BACKGROUND OF THE INVENTION

A. Field of The Invention

The present invention relates to spouts for providing a stream of water in the shape of a sheet or curtain. The invention is especially useful as a bathtub spout.

B. Description Of The Prior Art

Spouts for providing a sheet flow of water, such as into a bathtub, are known. Streams so shaped are aesthetically pleasing and also do not make as much noise as typical cylindrical or turbulent flow streams. For example, U.S. Pat. No. 4,334,328 describes such a spout with a wide, thin, flat, horizontal flow chamber.

Maintaining the shape of the stream in a sheet becomes more difficult the further the stream flows from the spout on its way into a tub or whirlpool. The sheet shape tends to become turbulent and irregular the further the stream flows from the spout. This can detract from the appearance of the sheet and can cause a more noisy flow. Therefore, it can be seen that a need exists for a spout which provides a sheet-like flow stream which maintains its shape even relatively far from the spout.

SUMMARY OF THE INVENTION

The invention provides a spout for forming a flow of water in the shape of a sheet of the type having an inlet for admitting a flow of water and an elongated outlet for permitting the water to exit the spout. The outlet is narrower in the central region of the outlet than at the outer regions of the outlet. The narrowing assists in inhibiting the exiting sheet of water from collapsing toward the center of the water stream.

In a preferred form, the spout has a reservoir for pooling the flow of water from the supply pipe. A weir has a crest in communication with the reservoir and a flow surface extending from the crest. Means in combination with the flow surface of the weir define a flow chamber, at least a portion of which is thinner near the center than at the sides. When the pool reaches the level of the crest, water flows past the crest and the flow surface to exit the spout in the form of a sheet. In this form, a center section of the flow surface is raised to define the thinner portion of the flow chamber.

In another aspect, the flow surface diverges in width in the direction of flow up to a mouth through which the stream exits the spout. By diverging all the way up to the mouth, the stream fans out as it leaves the spout to help counter the tendency of the stream to become turbulent and irregular.

In another aspect, the center section is adjacent to the mouth so that the mouth is thinner in the center than at the sides. By positioning the center section adjacent to the mouth, fanning of the stream after it exits the spout is enhancd.

In an especially useful form, the center section of the flow surface is defined by a surface which is arcuate in each of two orthogonal directions. Preferably, one of the directions is in the direction of flow and the other direction is transverse to the direction of flow. A first radius defines the center section in the one direction to be concave up and a second radius defines the center section in the other direction to be convex up. This shape has been found to effectively promote the formation of a relatively stable sheet-shaped flow stream.

In another aspect, the means defining a flow chamber includes a top surface opposite from the flow surface. At least a portion of the top surface converges toward the flow surface in the direction of flow. This feature further promotes the development of the sheet-shaped stream by gradually thinning the stream.

It is therefore a principal object of the invention to provide a spout for connection to a water supply pipe to form a flow stream in the form of a sheet.

It is another object of the invention to provide such a spout to form such a flow stream which maintains a sheet shape relatively far from the spout.

It is another object of the invention to provide a spout which can in large part be inexpensively manufactured.

These and other objects and advantages of the invention will become apparent from the detailed description and from the drawings, which are described as follows:

DESCRIPTION OF THE DRAWINGS

FIG. 1 is a sectional view taken along plane 1—1 of FIG. 2 of a spout of the invention;

FIG. 2 is a view of the outlet of the spout taken along plane 2—2 of FIG. 1;

FIG. 3 is a front elevation view of a base for the spout of FIG. 1;

FIG. 4 is a rear elevation view of the base of FIG. 3;

FIG. 5 is a front elevation view of a back for the spout of FIG. 1;

FIG. 6 is a section view taken along plane 6—6 of FIG. 3;

DETAILED DESCRIPTION OF THE PREFERRED EMBODIMENT

Figure 7:
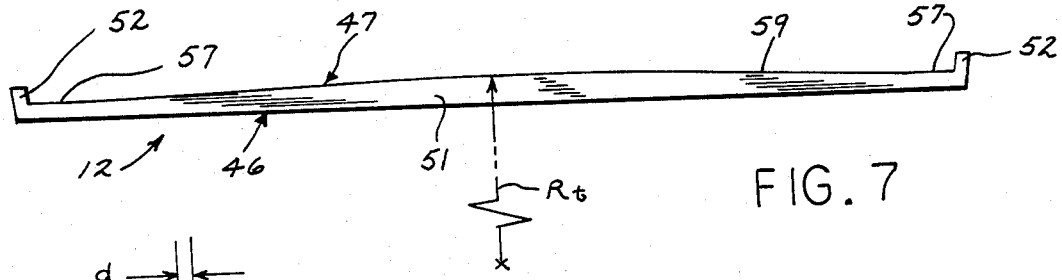
FIG. 7 is a view of the front edge of the base taken along plane 7—7 of FIG. 6.

Referring to FIG. 1, a sheet flow spout 10 of the invention is illustrated. The spout 10 includes a base 12, a back 13, a cover 15, a facade 16, a collar 18, an insert 19, an O-ring 20, a cover plate 21 and a screw 22. All of the parts except the collar 18, screw 22, facade 16 and O-ring 20 are preferably molded plastic. The facade 16, collar 18 and screw 22 are metal and the O-ring 20 is an elastomer.

The rearmost surface 24 of the spout is flat to abut a vertical wall W (shown in phantom). A water supply pipe P (shown in phantom) protrudes from the wall and extends into the insert 19 to form a water-tight seal with the O-ring 20. The screw 22 can be tightened from beneath the spout to bear against the water supply pipe P to securely connect the spout to the water supply pipe. The spout 10 could also be adapted for connection to a vertical supply pipe.

Referring to FIG. 5, the front of the back 13 has a number of reinforcing ribs 30. An annular groove 32 is defined between a ring projection 34 and a tubular projection 35 of the back 13. The forward end of the tubular projection 35 is closed by a wall 36 and a transverse bore 38 extends through opposite sides of the tubular projection 35 near the end thereof. The rear portion of the tubular projection 35 has a larger inside diameter than the forward portion to define a shoulder against which the O-ring 20 seats. After inserting the O-ring 20, the insert 19, which has an inside diameter approximately equal to the inside diameter of the forward portion of the tubular projection 35, is inserted.

The collar 18 is annular and sized to fit into the annular groove 32. The inside diameter of the collar 18 is tapered to match the outer diameter of the rear portion of the tubular projection 35 to provide a tight fit between the collar 18 and tubular projection. The cover plate 21 has inner 39 and outer 40 stepped edges to match similarly stepped edges on the ring portion 34 and tubular projection 35. The cover plate 21 is sealed to the ring projection 34 and tubular projection 35 by ultrasonic welding, a suitable bonding agent or other appropriate means so as to make the joints between the cover plate and back 13 water-tight. The collar 18 has a threaded hole to engage the screw 22 which screw extends through a hole in the tubular projection 35 and a hole in the insert 19.

Referring to FIGS. 4 and 5, the rear edge 41 of the base 12 is sized and shaped to conform to the back 13. A rearmost edge 42 of the base 12 is stepped around its entire periphery except at the bottom to receive the back 13. A bottom portion 43 of the rear edge 41 is formed in the shape of a rearwardly opening "U" to receive a similarly shaped surface 44 of the back 13. This surface provides a "U"-shaped opening in the bottom rear of the spout 10 to allow access to the screw 22. The joint between the base 12 and back 13 is sealed by ultrasonic welding, a suitable bonding agent, or other appropriate means around its entire periphery to be water-tight.

The rear of the base 12, including the rear edge 41, is defined by a portion 45. The lower approximately 3/5 of the front of portion 45 terminates in the rearward side of a duck bill-shaped weir 46. Referring to FIG. 6, the forward edge of the upper portion of the portion 45 defines an upper forward edge 49 of the base 12. The weir 46, back 13 and portion 45 form a reservoir 37 between them.

The top of the weir 46 defines a crest 50 and the weir has a flow surface 47 on its front, upper side which diverges as it slopes downwardly. Substantially vertical side walls 48 extend upwardly from the edges of the weir 46 to define top edges 53 which slope downwardly continuously and fan out from the forward edge 49. A front edge 51 of the weir 46 is continuous with forward edges 52 of the side walls 48 to define the bottom edge and side edges, respectively, of an outlet or mouth 55.

The cover 15 is smoothly arched concave up to conform with the edges 49 and 53 and to overlie the front of the base 12. It is not dished in the direction transverse to flow. The joint between the cover 15 and the base 12 around the edges 49 and 53 is sealed by ultrasonic welding, a bonding agent, or other appropriate means to be water-tight. Together with the side walls 48 and the weir 46, the cover 15 defines a flow chamber 54. Also, the front edge of the cover 15 defines the top edge of the outlet ormouth 55. The facade 16 is shaped to overly the front and sides of the cover 15 and preferably has a polished metal finish for aesthetics.

Water from the water supply pipe enters the tubular projecton 35 and is diverted orthogonally in two directions normal to its flow direction by the wall 36 out through the bore 38 from opposite sides of the tubular projection into the reservoir 37. This diversion minimizes turbulence in the reservoir which may otherwise interfere with the initial formation of the sheet-shaped stream. When the level in the reservoir reaches the crest 50, the water spills over the crest and flows down the flow surface 47 and out through the mouth 55.

Referring to FIGS. 3 and 6, the flow surface 47 is shaped to insure that a sheet-like stream issuing from the spout remains in the sheet shape even relatively far from the spout. To help insure this, the flow surface 47 is made up of four sections the divisions between which aare illustrated by phantom lines in FIGS. 3 and 8. A flat section 56 (FIGS. 3 and 9) is provided adjacent to the crest 50 where the sheet-shaped stream begins. Thus, the crest 50 is substantially straight and horizontal to promote the formation of the sheet and the flat surface allows the sheet to reach some level of stability early in its development.

Adjacent to the lower side of the flat section 56 are two side sections 57 and a center section 59 between the side sections 57. Referring to FIG. 6, the sections 57 are defined by a certain radius $R_{p57}$ to be concave up in the direction of flow (the direction of flow being defined along a longitudinal center line 60 (FIG. 8) in the preferred embodiment). In the spout 10, the sections 57 are defined by surfaces shaped as shown by the phantom lines of an imaginary cylinder of radius $R_{p57}$ having an axis A-1 which is transverse to the direction of flow. Thus, the sections 57 are not dished in the direction transverse to flow.

Figure 11:
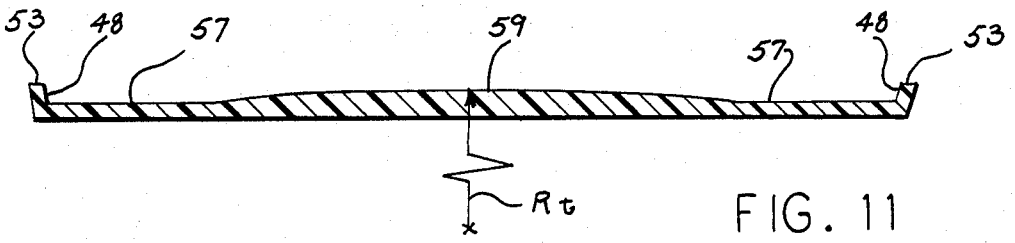
FIG. 11 is a section view similar to FIG. 9 but taken along line 11—11 of FIG. 3.
Figure 10:
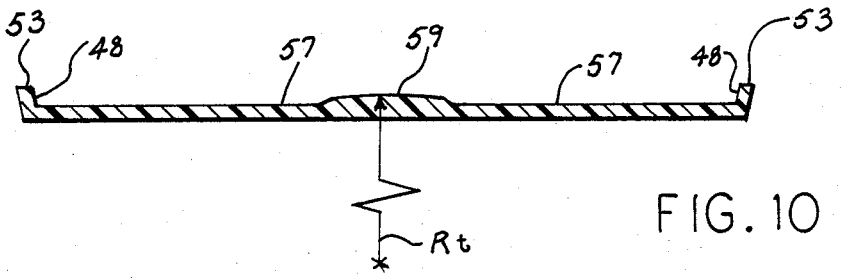
FIG. 10 is a section view similar to FIG. 9 but taken along line 10—10 of FIG. 3.

The section 59 diverges in the direction of flow and is defined by a radius $R_{p59}$ to be concave up in the direction of flow but is also defined by another radius $R_t$ to be convex up in the direction transverse to the direction of flow. That is, not only is the section 59 arcuate according to a certain radius $R_{p59}$ as shown in FIG. 6, it is also arcuate according to a certain radius $R_t$ as shown in FIG. 7. The transverse curvature $R_t$ of the flow surface 59, as well as its divergence, is also depicted in FIGS. 10 and 11. In the preferred embodiment, the flat surface 56 is approximately two inches long in the direction of flow, $R_{p57}$ is about 8.4 inches, $R_{p59}$ is about 7.3 inches and $R_t$ is about 65 inches.

The result of this construction is that the flow surface 59 is raised in the center section 59 relative to the side sections 57. This causes the flow chamber 54 to be thinner near the center than at the sides in the area of the center section 59. Also, because the center section 59 is adjacent to the mouth, the mouth is also thinner in the center than at the sides as best shown in FIG. 2. With the upper surface of the mouth flat and the lower surface convex in the center thereof, the mouth is in the shape of a single concave lens. It has been found that this arrangement results in a substantially laminar flow in the form of sheet out through the mouth which maintains its sheet-like appearance relatively far from the spout.

It should also be noted that in the flow chamber 54, the cover 15 converges toward the weir 46 in the direction of flow in the area of the flat section 56. This feature helps promote the formation of the sheet by gradually flattening it out to the desired thinness.

Figure 8:
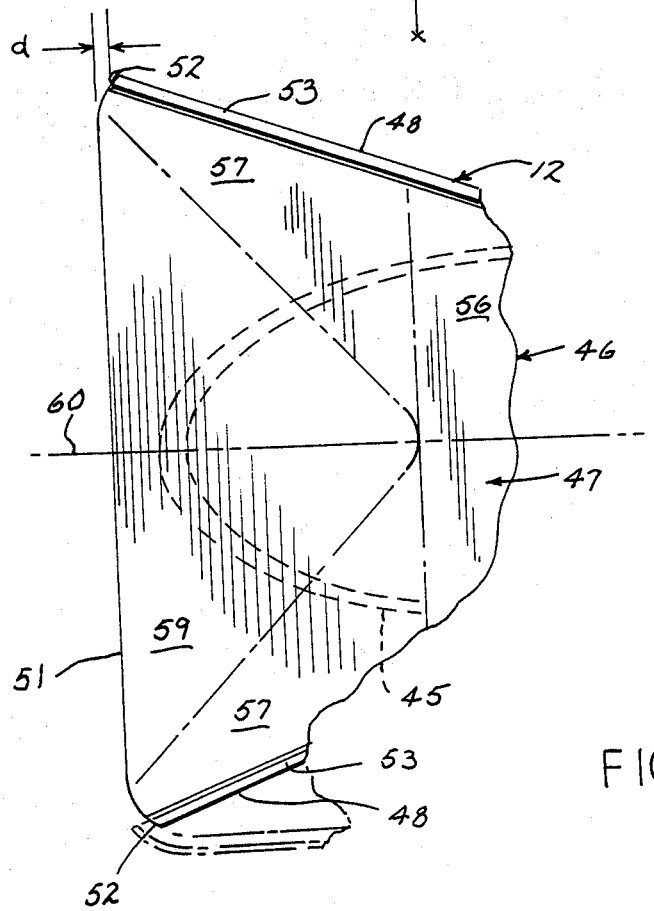
FIG. 8 is an elevation view taken along plane 8—8 of FIG. 6.
Figure 9:
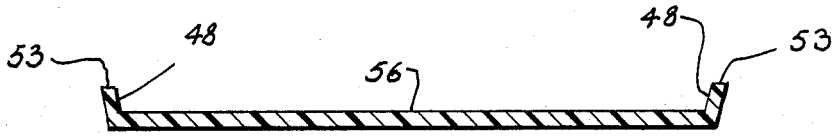
FIG. 9 is a section view taken orthogonally to the direction of flow along line 9—9 of FIG. 3 illustrating a cross-section of a flow surface of the spout.

Referring to FIG. 8, the lower edge of the mouth 55, which is defined by the front edge 51 of the weir 46, recedes at its ends from its foremost edge a distance d in the direction opposite to the flow. Also, the sidewalls terminate the same distance d back from the foremost lower edge of the mouth.

It will be obvious to those of ordinary skill in the art that many modifications are possible to the preferred embodiment without deviating from the scope of the invention. For example, the spout 10 need not be in the orientation shown as it would also provide a sheet-shaped stream in a different orientation, such as upside down from the orientation illustrated. Also, the cover 15 could be raised in the center thereof to at least in part provide the thinning of the chamber 54. Therefore, it is not intendd that the invention be limited by the preferred embodiment, but that it be deinfed by the claims as follows.

We claim:

1. A waterflow spout of the type having an inlet for admitting a flow of water, a flow chamber downstream of the inlet and an elongated outlet downstream of the flow chamber for permitting the water to exit the spout, the flow chamber defining a passageway for water movement from said inlet to said outlet, the improvement wherein:

the flow chamber has a elongated crest downstream of the inlet and upstream of the outlet and said flow chamber slopes downwardly and diverges in the downstream direction from the crest toward the outlet;

the flow chamber has a center section and side sections, said center section being arcuate in each of two orthogonal directions, the center section being narrower top to bottom than the side sections and diverging in width in the direction of flow, wherein one of said two orthogonal directions is in the direction of flow and the other of said directions is transverse to the direction of flow, a first radius defines the center section in the flow direction to be concave up, and a second radius defines the center section in the transverse direction to be convex up;

the flow chamber is defined at least in part by upper and lower flow surfaces which converge toward one another, at least one of said flow surfaces having a central section which is raised relative to side sections of the flow surface and said raised portion diverges in width in the direction of fluid flow to define in part the center section of the flow chamber;

the raised central section of at least one of the flow surfaces is adjacent to the outlet to define the outlet narrower in the center than at the sides; and whereby the narrowing of the center section of the flow chamber and the center of the outlet assists in inhibiting the water exiting the outlet from collapsing toward the center of the water stream to maintain the exiting water in a continuous sheet shape for a distance outside of the spout.

2. A spout as in claim 1, wherein the upper and lower flow surfaces converge toward one another.

3. A spout as in claim 1, wherein the center section of the flow chamber is arcuate in each of two orthogonal directions.

4. A spout as in claim 3, wherein one of said directions is in the direction of flow and the other of said directions is transverse to the direction of flow, a first radius defines the center section in the flow direction to be concave up, and a second radius defines the center section in the transverse direction to be convex up.

* * * * *

UNITED STATES PATENT AND TRADEMARK OFFICE
CERTIFICATE OF CORRECTION

PATENT NO. : 4,823,409

DATED : April 25, 1989

INVENTOR(S) : Thomas E. Gaffney and Patrick S. Wahlen

It is certified that error appears in the above-identified patent and that said Letters Patent is hereby corrected as shown below:

Column 1, line 58, "enhancd" should be --enhanced--.

Column 3, line 61, "ormouth" should be --or mouth--.

Column 3, line 65, "projecton" should be --projection--.

Column 4, line 11, "aare" should be --are--.

Column 4, line 55 after "of", "a" should appear.

Column 5, line 10, "intendd" should be --intended--.

Column 5, line 11, "deinfed" should be --defined--.

Column 5, Claim 1, line 21, "a" should be --an--.

Column 6, Claims 2, 3 and 4 should be cancelled.

Signed and Sealed this

Tenth Day of April, 1990

*Attest:*

*Attesting Officer*

HARRY F. MANBECK, JR.

*Commissioner of Patents and Trademarks*